US005419485A

United States Patent [19]

Petriekis et al.

[11] Patent Number: 5,419,485

[45] Date of Patent: May 30, 1995

[54] END OPENING REINFORCED BULK MATERIAL BOX

[75] Inventors: Paul F. Petriekis, Palos Park; Michael Wilford, Downers Grove, both of Ill.

[73] Assignee: Packaging Systems, Inc., Westmont, Ill.

[21] Appl. No.: 253,955

[22] Filed: Jun. 3, 1994

[51] Int. Cl.[6] ..... B65D 5/32; B65D 5/54

[52] U.S. Cl. ..... 229/23 R; 220/465; 229/243; 229/918; 229/919

[58] Field of Search ..... 229/23 R, 23 C, 240, 229/242–244, 915, 918, 919; 220/462, 465

[56] References Cited

U.S. PATENT DOCUMENTS

| | | | |
|---|---|---|---|
| 2,606,709 | 8/1952 | Carey et al. | 229/23 R |
| 2,823,846 | 2/1958 | George | 229/23 R |
| 3,099,379 | 7/1963 | Stease | 229/23 R |
| 3,214,076 | 10/1965 | Gagnon | 229/23 R |
| 3,253,764 | 5/1966 | Goetschius et al. | 229/17 |
| 3,756,471 | 9/1973 | Wissman | 220/465 |
| 3,905,541 | 9/1975 | Paxton | 229/23 R |
| 3,993,239 | 11/1976 | Exel | 229/23 R |
| 4,549,673 | 10/1985 | Kupersmit | 220/465 |
| 4,793,494 | 12/1988 | Gordon, Jr. | 229/23 R |
| 4,815,631 | 3/1989 | Eeg et al. | 220/403 |
| 4,986,466 | 1/1991 | Colby | 229/126 |
| 5,054,644 | 10/1991 | Greenslade | 220/403 |
| 5,143,278 | 9/1992 | Petriekis et al. | 229/23 |
| 5,265,753 | 11/1993 | Moorman | 220/465 |
| 5,333,777 | 8/1994 | Roth | 229/23 R |
| 5,335,844 | 8/1994 | Young | 229/23 R |

*Primary Examiner*—Gary E. Elkins

*Attorney, Agent, or Firm*—Wallenstein & Wagner, Ltd.

[57] ABSTRACT

An end opening bulk material container having a plurality of sidewalls defining a polygonal sleeve, the sleeve has a depth dimension greater than its width dimension, a first end of the sleeve is closed by a first end wall and two C-shaped supports, one of each is associated with separate side walls.

11 Claims, 4 Drawing Sheets

100
106
108
6
30
32
34
36
38
40
46
62
64
66
68
70
72
210

END OPENING REINFORCED BULK MATERIAL BOX

TECHNICAL FIELD

The present invention relates generally to bulk material containers and specifically to reinforced corrugated flatboard containers for shipping bags of liquid.

BACKGROUND OF THE INVENTION

Liquid products such as soft drink syrup or chemical products are often shipped in small volumes such as five gallon portions. These liquid volumes may be packaged in a plastic bag and housed within a paperboard container to protect the bag from puncture or compression. This method of packaging is often referred to as "bag in box." The bag is often provided with a fitment or a spout and the box with a corresponding access door to allow access to the contents of the bag through a wall of the box.

Prior boxes that have been specially designed to enclose and transport these five gallon bags usually are six sided boxes folded from a single sheet of corrugated paper that is folded and glued along a single glue lap to an outside wall of the box. The boxes usually have bottom and top walls that are formed from the overlap of major and minor flaps, and the box usually folds flat for storage. The boxes also have a perforated section along an end wall that may be removed to accommodate the spout so that liquid may be removed from the bag without opening the top of the box.

However, these prior boxes have presented several problems to manufacturers and distributors. For example, distributors have discovered that these boxes have insufficient structural support and that movement of the liquid filled bag within the box may cause the box to unfold or breakdown during warehousing and distribution. Further, the boxes have inadequate stacking strength and may crush, or have its perforated spout break out or the box may otherwise be damaged under the weight of a palletized load. In more serious cases where the perforated spout breaks out a tear forms in a side or end panel of the box which follows the paperboard corrugations causing the box to rip open. In all cases, the box is rendered incapable of protecting the contents of the bag from outside hazards that may puncture the bag and release its contents.

Manufacturers and distributors have also encountered problems with this box. For example, the glue lap that was provided to hold prior boxes together, oftentimes became unglued during the loading of the box with a liquid filled bag causing the entire box to unfold. Further, the manufacturers have had difficulty in detecting leaks in these boxes until after the boxes have been filled and prepared for shipment or actually shipped. Manufacturers have also had difficulty, in loading the prior boxes, to get the liquid filled bags to cover the entire bottom of the box for even weight distribution.

Improvements have been made to the single piece containers by constructing a container from three separate pieces of corrugated paperboard. An example of such a container is disclosed in U.S. Pat. No. 5,143,278 which is assigned to the owner of the present invention and is incorporated herein by reference. The '278 Patent discloses a top loaded container which has reinforcing flanges that add considerable support to the container far in excess of single piece boxes. However, even the container disclosed in the '278 Patent must be stacked on a pallet with each box in conformation with the lower box, that is sidewall over sidewall and end wall over end wall, in a column stacking pattern to avoid damaging the container on panels 32 and 36 between side flanges 120.

For these reasons, it is desirable to produce a more cost effective box for shipping liquid filled bags, that has greater stacking strength than boxes presently being used so that the boxes may be stacked on a pallet in an interlocking fashion, that is one box may be placed transverse to a lower box, or shipped in single increments by common courier such as U.P.S.

SUMMARY OF THE INVENTION

The present invention provides a reinforced corrugated paper box and corrugated paper blanks for forming the box that may be used for the shipment of liquid filled bags, and other bulk material.

According to the present invention, a container is provided comprising a plurality of sidewalls defining a polygonal shaped sleeve. Preferably, there are four sidewalls defining a rectangular sleeve. The sleeve has first and second ends, inner and outer surfaces, and a depth and a width dimension. The depth dimension is greater than the width dimension. The sleeve has a smooth inner surface. A first end wall located at the first end of the sleeve closes the first end of the sleeve. At least two C-shaped supports extend from the first end of the sleeve toward the second end of the sleeve along a periphery of two opposed side walls.

Each sidewall of the container has a top flap hingedly connected thereto, each of the top flaps being folded to form a second end wall to close the second end of the sleeve. The first and second end walls are parallel to an axis of stacking of the container and provide additional support to the container.

An access door is provided in an end wall, preferably the second end wall, to allow access to the contents of a bag stored within the container. The door has a detachable section that preferably is circular in shape.

Preferably, the box has one or two holes in one of the walls of the container. These holes allow for the passage of air and liquid. Consequently, when a liquid filled bag is dropped into the box, air is displaced through the hole or holes allowing the contents of the bag to evenly distribute over the second end wall of the box. Also, the holes allow for early leak detection by allowing liquid to pass out of the box immediately after the leak occurs.

The present invention also provides for a system for forming the container described above. The system includes corrugated paper blanks for cooperatively forming the present container. To form the preferred rectangular container, the blanks comprise an elongate body blank with opposed lateral sides, and two side blanks each having opposed lateral sides, and opposed top and bottom ends. Transverse fold lines extending between the opposed lateral sides of the body blank divide the body blank into a first, a second, a third, a fourth and a fifth panel. Body flanges extend from the opposed lateral sides of the body blank from the second, third and fourth panel. These body flanges attach the body blank to the side blanks.

The side blanks preferably have top and bottom closing flaps that are foldable to form supports parallel to the stacking access of the container. Preferably the side blanks are made from two ply corrugated paperboard.

The three piece construction of the container allows one to interchange the stock of material used to build the container. For example, one could use a single ply corrugated paper for the body blank, and a double ply corrugated paper for the side blanks. The double ply corrugated paper side walls will add substantial structural support to the box.

DETAILED DESCRIPTION

Figure 1:
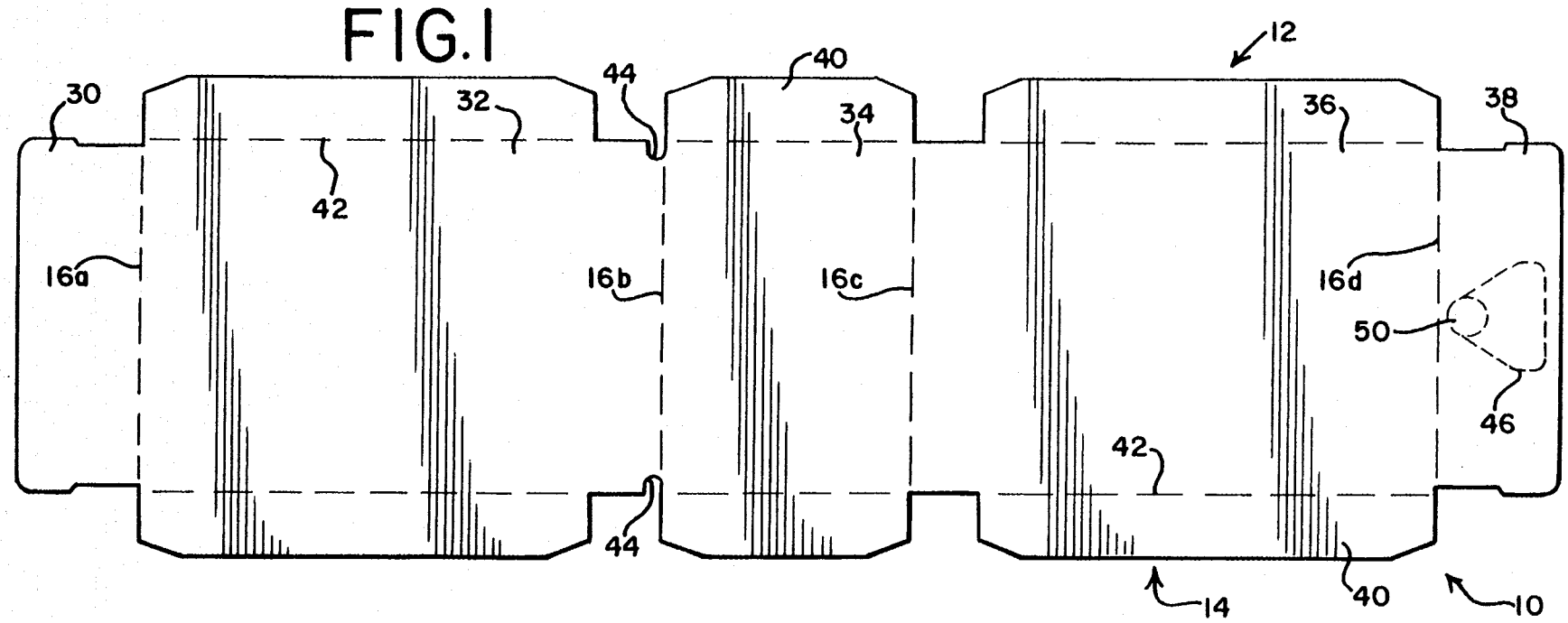
FIG. 1 is a top view of an elongate body blank of the present invention.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated.

FIG. 1 shows an elongate body blank 10 having first and second lateral Sides 12 and 14. Transverse fold lines 16*a–d* extend 15 between the first and second lateral sides 12 and 14 to define a first, a second, a third, a fourth, and a fifth panel 30, 32, 34, 36, and 38. The body blank 10 may be folded along the transverse fold lines 16*a–d* to form a C-shaped sleeve. Preferably the body blank 10 is made from single-ply corrugated paperboard.

Body flanges 40 extend from the first and second lateral sides 12 and 14 of the body blank 10 at the second, third, and fourth panels, 32, 34, and 36. Marginal fold lines 42 separate the body flanges 40 from the body blank 10.

Notches 44 are removed from the first and second lateral edges 12 and 14 of the body blank 10 at the intersection of the second and third panels 32 and 34. The notches 44 provide a hole in the assembled container to allow for the passage of liquid and air.

The fifth panel 38 has a centrally located perforated section defining an access door 46. An upper portion of the door is not perforated so that it may function as a hinge 48. A circular shaped perforated section 50 at a distal end of the door 46 may be completely detached from the body blank 10 to form a circular hole. In the fully assembled container, the circular section 50 may be removed and the access door 46 pivoted outward to provide access to a fitment or spout of a bag (not shown) located within the assembled container. This access door 46 is not required when the assembled container is not used to ship liquid filled bags.

Figure 2:
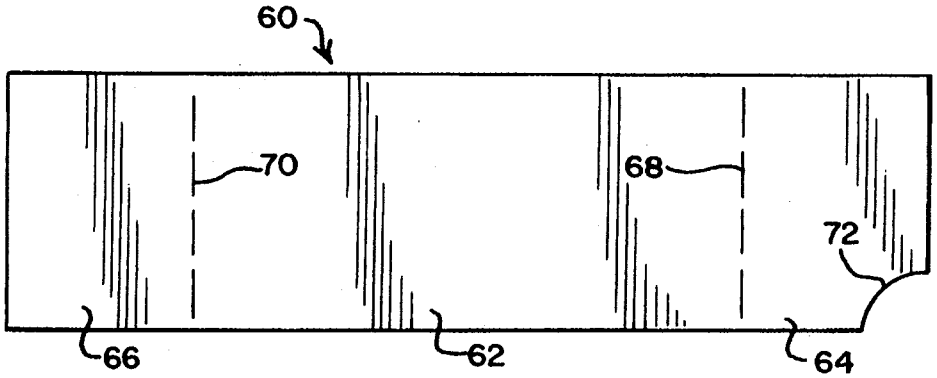
FIG. 2 is a side view of the side blank of the present invention.

FIG. 2 shows a side blank 60 made of corrugated paperboard having a central panel 62 and top and bottom flaps 64 and 66 hingedly connected to the central panel 62 along respective creases 68 and 70. The top flaps 64 may sometimes be referred to as minor flaps. A notch 72 is removed from a portion of the minor flap 64 to accommodate the passage of a spout of a bag enclosed within an assembled container. Preferably, the side blank is made from double ply corrugated paper for increased structural support. Further, preferably the paperboard corrugations extend laterally so that top and bottom flaps 64 and 66 fold more easily along creases 68 and 70.

To erect a container 100 (FIG. 3) from the body blank 10 and the side blank 60 one must use one body blank 10 and two side blanks 60. The body blank 10 is folded along the fold lines 16*b* and 16*c* to form a C-shaped sleeve. Two side blanks 60 are inserted into the C-shaped sleeve at opposite lateral edges 12 and 14 of the body blank adjacent the marginal fold lines 42. Panels 32 and 36 and panels 62 of side blanks 60 define a rectangular sleeve 73. The rectangular sleeve 73 has first and second ends 102 and 104, and a depth and width dimension 106 and 108. The depth dimension 106 should be greater than the width dimension 108. (See FIG. 3).

Figures 3, 4, 6:
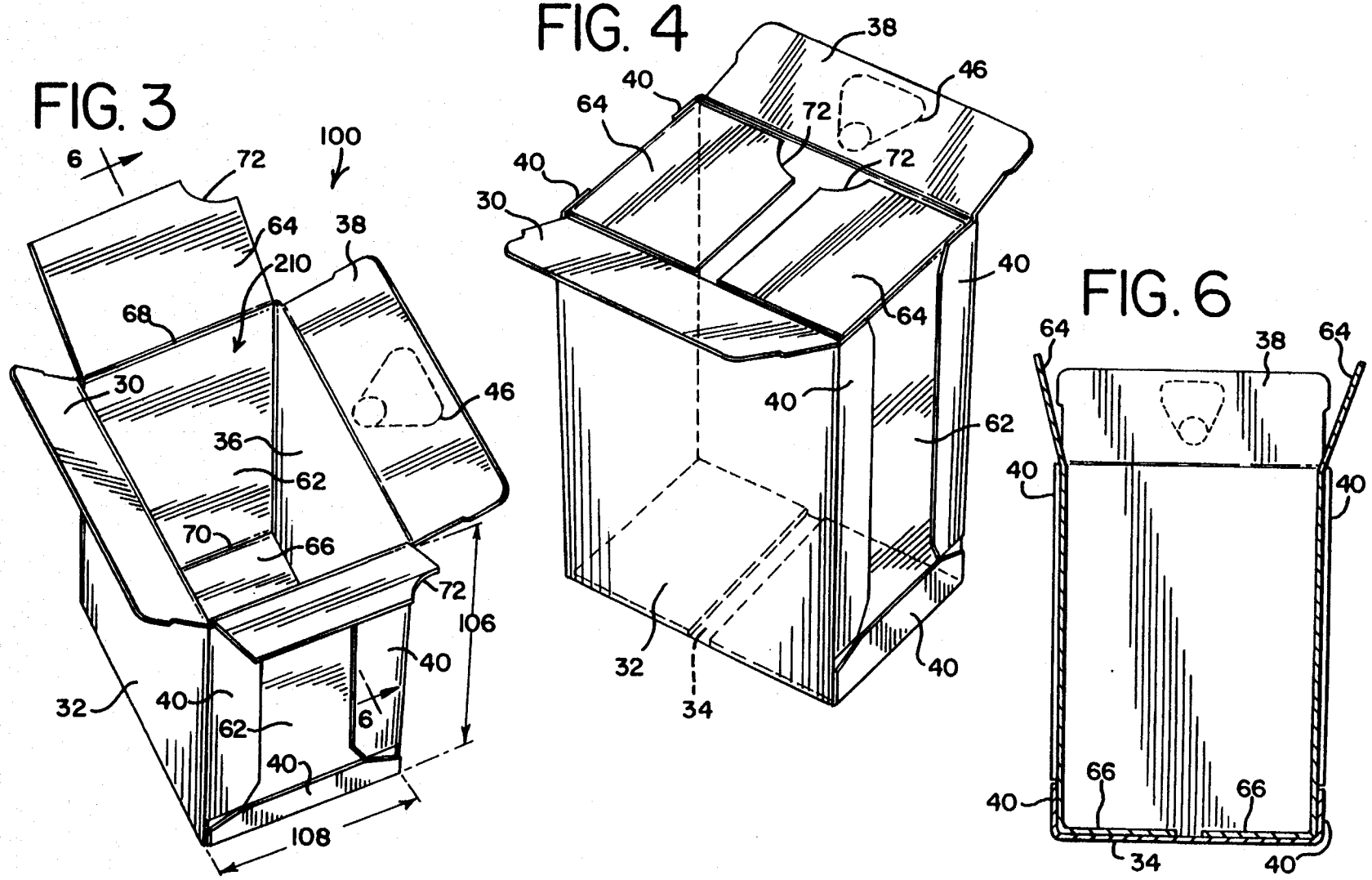
FIG. 3 is a perspective view of the container of the present invention in an open position.
FIG. 4 is a perspective view of the container of the present invention with minor flaps folded to a closed position.
FIG. 6 is a cross-section taken along line 6—6 of FIG. 3.

The bottom flaps 66 of each of the side blanks 60 are folded inward along creases 70 and the bottoms flaps 66 are attached to an inner surface of panel 34 (which sometimes may be referred to as the first end wall as it closes the first end of the rectangular sleeve 73) by gluing to form a double end wall. (FIG. 6). The notches 72 of the side blank 60 must each be facing panel 38 so that when folded inward to close the container they are in alignment with the access door 46. These notches are not required when the erected container is not used for shipping liquid filled bags.

The body flanges 40 along each lateral edge 12 and 14 of the body blank 10 are then folded inward along the marginal fold line 42 and attached to respective side blanks 60 by gluing. The flanges 40 form C-shaped supports 61 along a periphery of each of the side blanks 60, two of the legs 75 of the C-shaped support extend from the first end 102 of the rectangular sleeve 73 toward the second end 104 of the sleeve 73.

Figure 5:
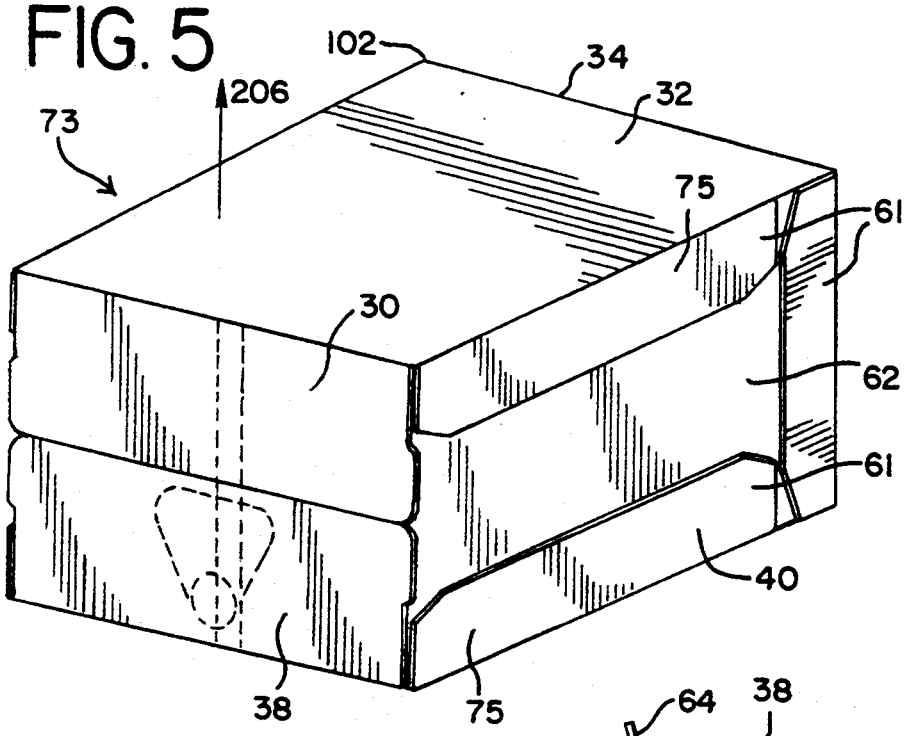
FIG. 5 is a perspective view of the container of the present invention with both major and minor flaps folded to a closed position.

To close the second end 104 of rectangular sleeve 73 of the container 100, the minor flaps 64 of the side blank 60 are folded inward of the sleeve 73 along the fold lines 68 (FIG. 4). Then panels 30 and 38, which may be referred to as major flaps, are folded inward on top of the minor flaps 64 and glued thereto (FIG. 5) to close the container 100.

When the container 100 is used to package a liquid filled plastic bag (not shown), the minor flaps 64 act as a plow to push the bag into the container 100 after loading. Further, the minor flaps 64 also serve to shield the bag from the damaging effects caused by contact with hot glue during the process of gluing the major flaps 30 and 38 to the minor flaps 64.

Figure 7:
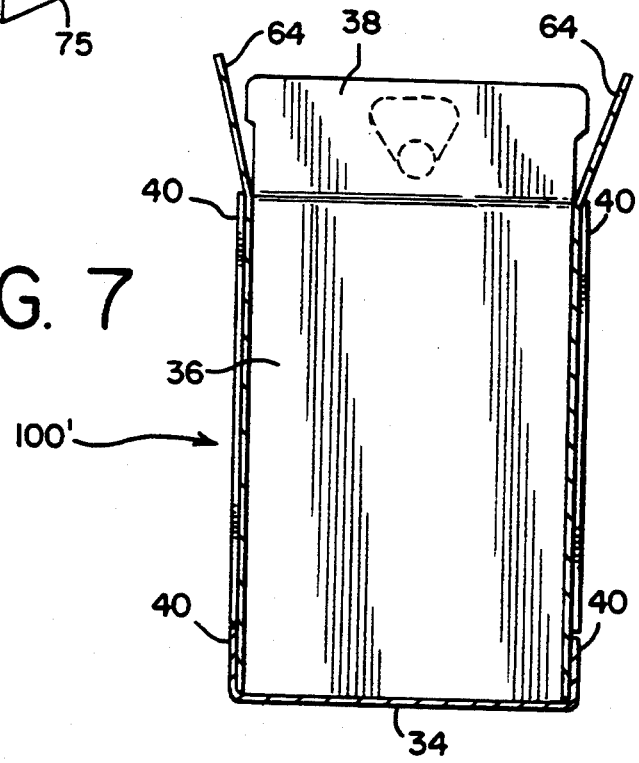
FIG. 7 is a cross-section of an alternate embodiment of the container of the present invention.
Figure 8:
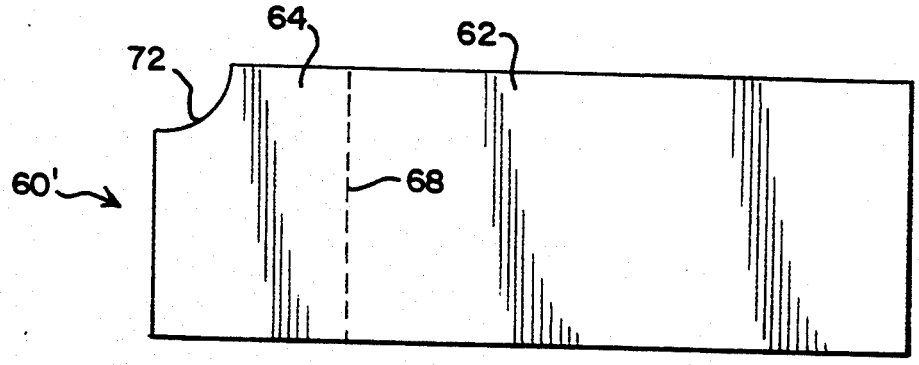
FIG. 8 is a side view of an alternate embodiment of the side blank for constructing the container of FIG. 7.

In an alternate embodiment of the container 100', side blanks 60' shown in FIG. 8 are used instead of the side blank 60 shown in FIG. 2. Unlike side blank 60 30 (FIG. 2), side blank 60' does not include bottom flaps 66. Therefore, the first end wall 34 is of single thickness instead of double thickness. (FIG. 7). In all other respects the containers are the same; thus, the same numerical designations are used for corresponding parts.

Figure 10:
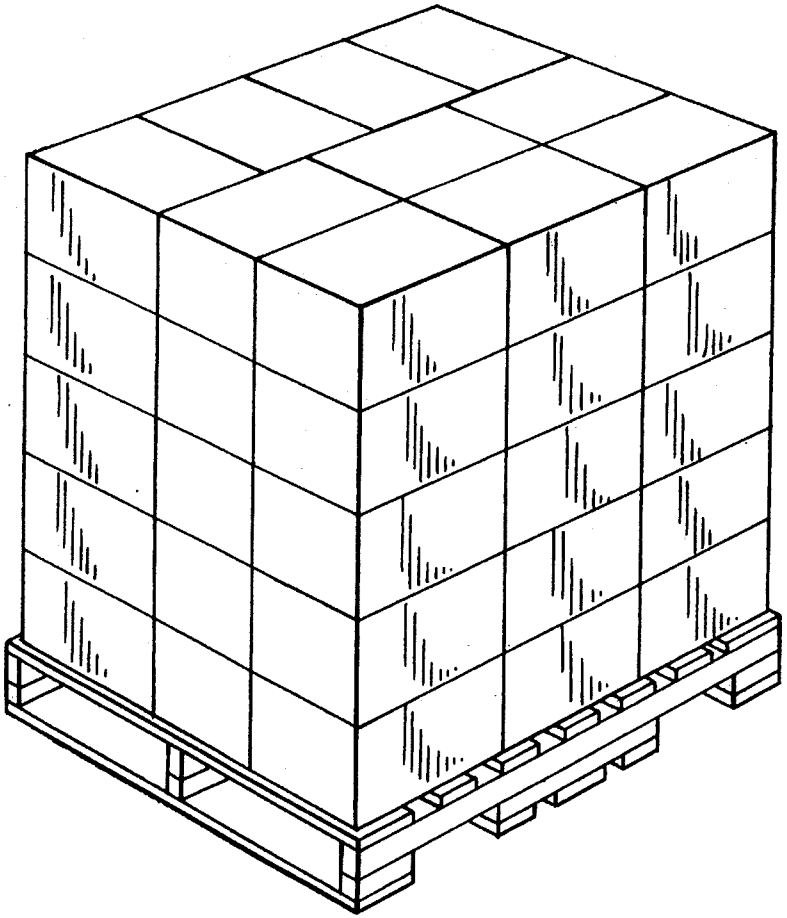
Figure 9:
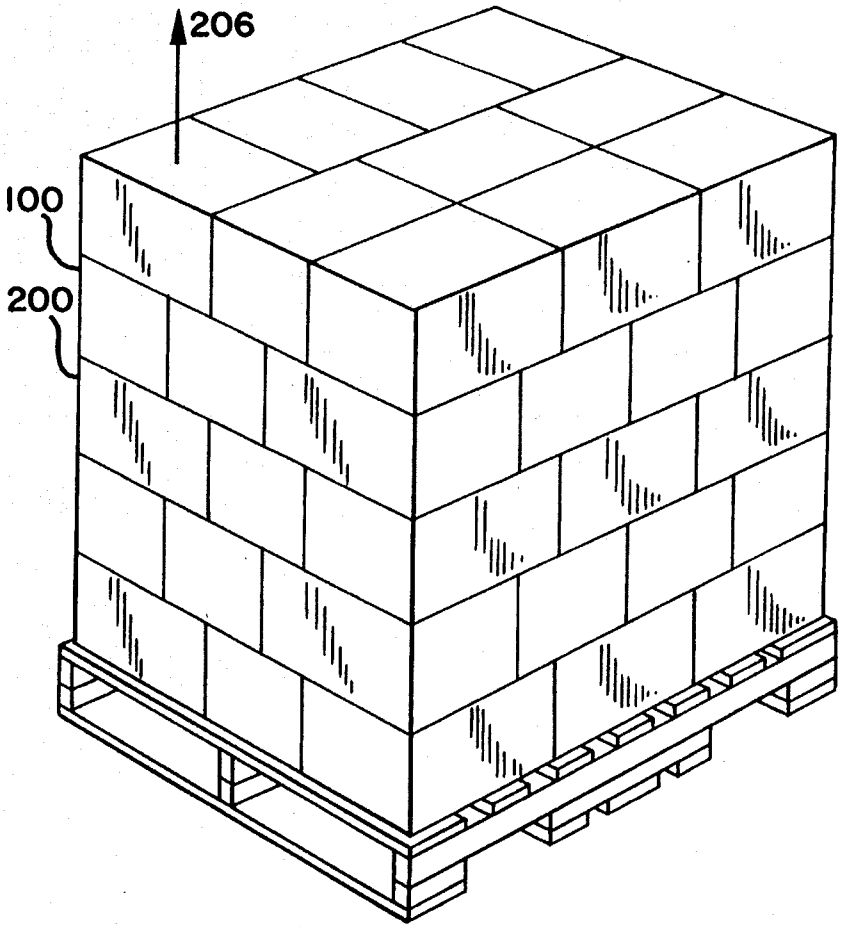
FIG. 9 is a diagrammatic view of containers stacked on a pallet in an interlocked fashion; and, FIG. 10 is a diagrammatic view of containers stacked on a pallet in a columnar fashion.

Because the major flaps 30 and 38 and minor flaps 64 are oriented along the axis in which the containers 100 will be stacked, or stacking axis 206, the container 100 may be stacked on a pallet in an interlocking fashion (FIG. 9) instead of a columnar fashion (FIG. 10). The interlocking stacking arrangement allows for stacking containers 100 cross-wise on top of containers 200 located on a layer below. Prior art containers such as the one shown in the '278 Patent, had insufficient structural support to be stacked in an interlocking fashion and had to be stacked in conformation with one another in a columnar stacking fashion shown in FIG. 10. The interlocking stacking arrangement (FIG. 9) provides a more stable palletized load than the columnar stacking arrangement (FIG. 10).

Further, because of the increased support gained through the orientation of the major flaps 30 and 38 and minor flaps 64, an internal surface 210 along panels 32 and 36 and side blanks 60 of container 100 is a continuous, and smooth surface without the need of internal flanges 120 shown in the '278 Patent.

Because of the increased structural support of the container 100, the container 100 may be used to ship single shipments using a common carrier such as U.P.S.

While the present container 100 has been described as generally rectangularly shaped, it is anticipated that the container could be constructed having various polygon shapes without departing from the present invention. Also, while the second end 104 of the rectangular sleeve 73 is closed by the cooperative folding of major and minor flaps, it is anticipated that a single side wall could carry a flap that could close the container 100 or a separate cap could be used to close the container 100 without departing from the present invention.

While the specific embodiments have been illustrated and described, numerous modifications come to mind without significantly departing from the spirit of the invention and the scope of protection is only limited by the scope of the accompanying claims.

We claim:

1. A container comprising:

a plurality of sidewalls defining a polygonal shaped sleeve, the sleeve having first and second ends, inner and outer surfaces, and a depth dimension and a width dimension, the depth dimension being greater than the width dimension;

a first end wall at the first end of the sleeve to close the first end of the sleeve; and, two C-shaped supports, one of each is associated with separate side walls.

2. The container of claim 1 wherein the rectangular sleeve has a smooth inner surface.

3. The container of claim 1 wherein a sidewall has a top flap hingedly connected thereto, the top flap being folded transverse to the sidewall to form a second end wall to close the second end of the sleeve.

4. The container of claim 3 wherein one of the first or second end walls has an access door.

5. The container of claim 4 wherein the access door is located on the second end wall.

6. The container of claim 1 wherein the container has a hole in a sidewall or end wall to allow for the passage of air or liquid.

7. The container of claim 1 wherein there are four sidewalls to define a rectangular sleeve.

8. The container of claim 3 further having an axis of stacking wherein the second end wall is parallel to the axis of stacking.

9. The container of claim 1 wherein at least one side wall has a bottom flap that is folded to overlap the first end wall to define a double end wall.

10. The container of claim 7 wherein two opposed side walls each have a bottom flap which are folded toward one another and overlay the first end wall to define a double end wall.

11. The container of claim 1 wherein each of the side walls have a top flap hingedly connected thereto, each of the top flaps being folded transverse to the side wall to form a second end wall.

* * * * *

UNITED STATES PATENT AND TRADEMARK OFFICE

CERTIFICATE OF CORRECTION

PATENT NO. : 5,419,485

DATED : May 30, 1995

INVENTOR(S) : Paul F. Petriekis and Michael Wilford

It is certified that error appears in the above-indentified patent and that said Letters Patent is hereby corrected as shown below:

Column 3, line 44: delete "15."

Column 4, line 66: delete "30."

Column 6, line 14, delete "rectangular" and insert --polygonal--.

Signed and Sealed this

Twenty-sixth Day of September, 1995

*Attest:*

*Attesting Officer*

BRUCE LEHMAN

*Commissioner of Patents and Trademarks*